US007248819B2

(12) United States Patent
Jeon

(10) Patent No.: US 7,248,819 B2
(45) Date of Patent: Jul. 24, 2007

(54) DEVELOPER DRIVING DEVICE AND IMAGE FORMING APPARATUS USING THE SAME

(75) Inventor: In-Cheol Jeon, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 114 days.

(21) Appl. No.: 11/148,188

(22) Filed: Jun. 9, 2005

(65) Prior Publication Data

US 2005/0276634 A1 Dec. 15, 2005

(30) Foreign Application Priority Data

Jun. 14, 2004 (KR) ..... 10-2004-0043451

(51) Int. Cl.
*G03G 15/045* (2006.01)

(52) U.S. Cl. ..... 399/159; 399/167; 74/665 L

(58) Field of Classification Search ..... 399/167, 399/116, 117; 74/665 L, 665 M, 665 N
See application file for complete search history.

(56) References Cited

U.S. PATENT DOCUMENTS 5,768,656 A * 6/1998 Nagasue et al. ..... 399/75
6,978,105 B2 * 12/2005 Chung et al. ..... 399/167
2002/0159779 A1 * 10/2002 Morioka et al. ..... 399/27

FOREIGN PATENT DOCUMENTS

| | | | |
|---|---|---|---|
| JP | 05-341616 | | 12/1993 |
| JP | 06-083119 | | 3/1994 |
| JP | 08-334943 | | 12/1996 |
| JP | 10-039662 | | 2/1998 |
| JP | 10-232556 | | 9/1998 |
| JP | 2002295610 | A * | 10/2002 |
| JP | 2003162148 | A * | 6/2003 |
| KR | 10-0260430 | | 4/2000 |
| KR | 2000-0014226 | | 7/2000 |
| KR | 2002-0068429 | | 8/2002 |
| KR | 10-0393075 | | 7/2003 |

* cited by examiner

*Primary Examiner*—David M. Gray
*Assistant Examiner*—David A Blackshire
(74) *Attorney, Agent, or Firm*—Roylance, Abrams, Berdo & Goodman, L.L.P.

(57) ABSTRACT

A developer driving device and an image forming apparatus are provided. The developer driving device includes a photosensitive drum driving gear installed on a flange which resides at one end a photosensitive drum on a photosensitive drum axis, that rotates the photosensitive drum connected to a main motor of a main body frame; and an intermediary gear installed to be able to perform a no-load operation on the flange, that rotates a developing roller driving gear connected to a sub motor of the main body frame. The photosensitive drum driving gear and the intermediary gear are connected to different motors.

8 Claims, 8 Drawing Sheets

DEVELOPER DRIVING DEVICE AND IMAGE FORMING APPARATUS USING THE SAME

CROSS-REFERENCE TO RELATED APPLICATIONS

This application claims the benefit under 35 U.S.C. § 119(a) of Korean Patent Application No. 10-2004-0043451, filed on Jun. 14, 2004, in the Korean Intellectual Property Office, the entire disclosure of which is incorporated herein by reference.

BACKGROUND OF THE INVENTION

1. Field of the Invention

The present invention relates to an image forming apparatus. More particularly, the present invention relates to an image forming apparatus including a developer driving device that does not pass on the overload of a developing roller onto a photosensitive drum by separately actuating the photosensitive drum and the developing roller.

2. Description of the Related Art

Generally, an image forming apparatus forms an electrostatic latent image on a photosensitive medium such as a photosensitive drum, develops the electrostatic latent image into an image with predetermined colors, and transfers, fuses and fixes the image onto a print paper, thereby producing a desired image.

Such an image forming apparatus has a developer, which can develop the electrostatic latent image into an image with predetermined colors, detachably installed in a main body frame. The developer accommodates a developing agent within a housing, and includes a photosensitive drum on which the electrostatic latent image is formed by an exposing unit, a developing roller that supplies the developing agent to the photosensitive drum and develops the electrostatic latent image, and a supplying roller that supplies the developing agent to the developing roller.

FIG. 1 is a perspective view of an example of a conventional developer driving device, FIG. 2 is a cross-sectional view of the developer driving device of FIG. 1, and FIG. 3 is a cross-sectional view of another example of a conventional developer driving device.

Referring to FIGS. 1 and 2, a housing 33 (see FIG. 2) covers a photosensitive drum 30 and a developing roller 40, and a photosensitive drum driving gear 31 is installed on one side of the photosensitive drum 30. The photosensitive drum 30 is rotatably supported by a photosensitive drum axis 32 that passes through the photosensitive drum driving gear 31. A developing roller axis 42 rotatably supports the developing roller 40, which is located adjacent to the photosensitive drum and develops the electrostatic latent image by supplying toner to the photosensitive drum 30. A developing roller driving gear 41 is installed on one end of the developing roller axis 42 to mesh with the photosensitive drum driving gear 31 and rotate. A portion of the photosensitive drum 30 is exposed out of the housing 33 and contacts a transfer roller (not shown). The photosensitive drum 30 transfers the toner image onto a print paper (not shown).

A portion of a driving gear 20 exists outside the main body frame 21, and is supported rotatably. The driving gear 20 rotates in connection to a main motor 10, and rotates the photosensitive drum driving gear 31.

Therefore, the photosensitive drum 30 rotates with the photosensitive drum driving gear 31, which is meshed with the driving gear 20, which is driving by the main motor 10.

Simultaneously, the developing roller 40 rotates with the developing roller driving gear 41, which is meshed with the photosensitive drum driving gear 31.

However, a jitter, which results in image irregularity in a printed image, can easily develop since an overload to the developing roller 40 affects the photosensitive drum 30, resulting in irregular rotation, due to the meshing of the photosensitive drum driving gear 31 and the developing roller driving gear 41. In addition, the photosensitive drum 30 transports through rotation, a print paper even when an image is not developed. In this case, the developing roller 40 continues to be driven by the developing roller driving gear 41, which is meshed with the photosensitive drum driving gear 31, thereby applying stress to the toner and lowering print quality.

Referring to FIG. 3, in order to prevent the problems of the conventional developer driving device of FIGS. 1 and 2, a coupler 51, which connects a photosensitive drum driving gear 31 and a developing roller 40, is installed in a main body frame 21, and is able to slide in the direction depicted by the arrows in FIG. 3. Therefore, the coupler 51 connects the photosensitive drum driving gear 31 and the developing roller 40, and drives the developing roller 40 only when performing a developing operation.

When mounting a developer on a main body frame, however, a door and a link structure are necessary to prevent contact with the coupler 51. Thus, there are limits to minimizing the size of the main body frame and the production price.

SUMMARY OF THE INVENTION

An aspect of the present invention is to solve at least the above problems and/or disadvantages and to provide at least the advantages below. Accordingly, the present invention provides a developer driving device and an image forming apparatus that prevents image irregularity by inhibiting a driving force overload in a developing roller from affecting the rotation of a photosensitive drum, and reduces unnecessary stress on toner.

According to an aspect of the present invention, a developer driving device, including a photosensitive drum driving gear installed on a flange on a photosensitive drum axis on one side of a photosensitive drum is provided. The photosensitive drum is rotated by a main motor located in a main body frame. The developer driving device also includes an intermediary gear installed to be able to perform a no-load operation on the flange, which rotates a developing roller driving gear by being connected to a sub motor in the main body frame. The photosensitive drum driving gear and the intermediary gear are connected to different motors.

BRIEF DESCRIPTION OF THE DRAWINGS

The above and other features and advantages of the present invention will become more apparent by describing in detail exemplary embodiments thereof with reference to the attached drawings in which.

Throughout the drawing, like reference numerals will be understood to refer to like parts, components and structures.

DETAILED DESCRIPTION OF EMAMPLARY EMBODIMENTS

Figure 1:
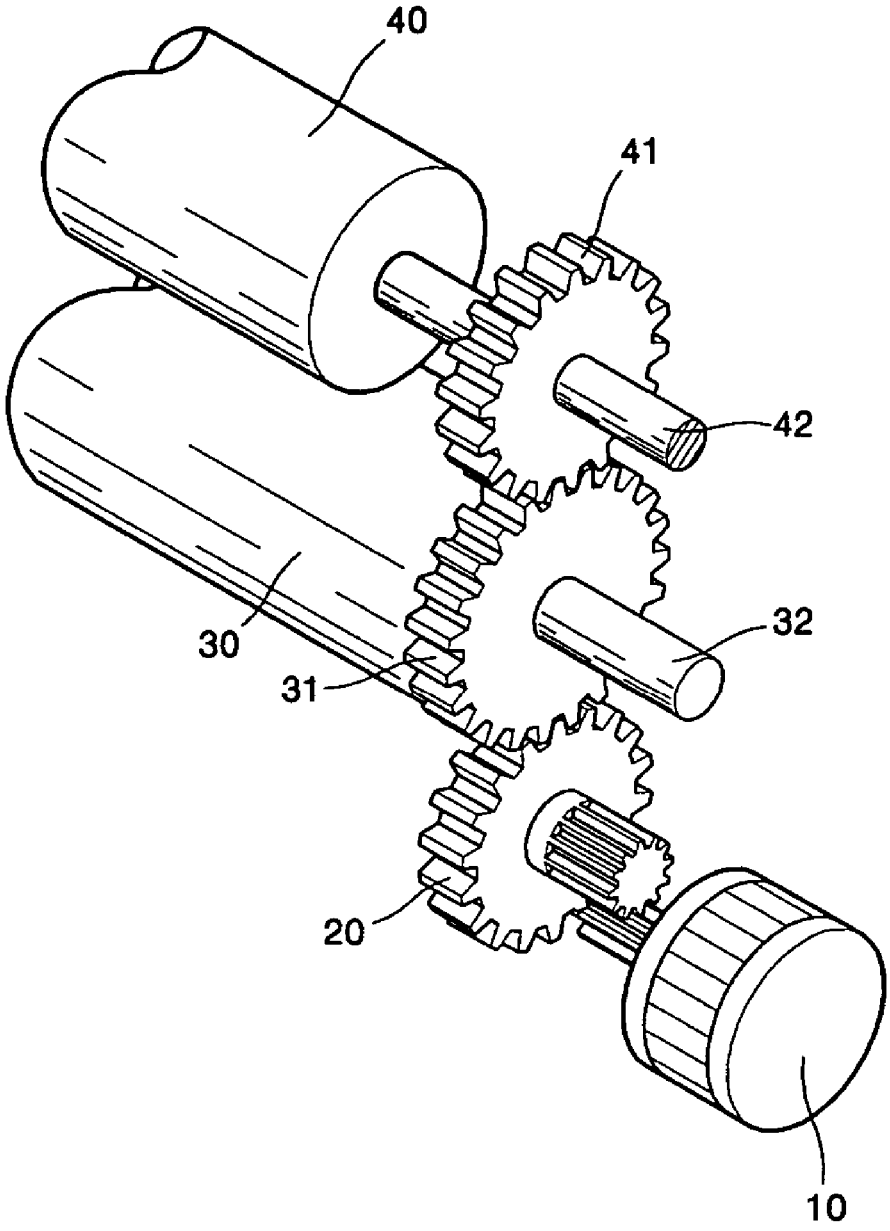
FIG. 1 (PRIOR ART)
FIG. 1 is a perspective view of an example of a conventional developer driving device.
Figure 2:
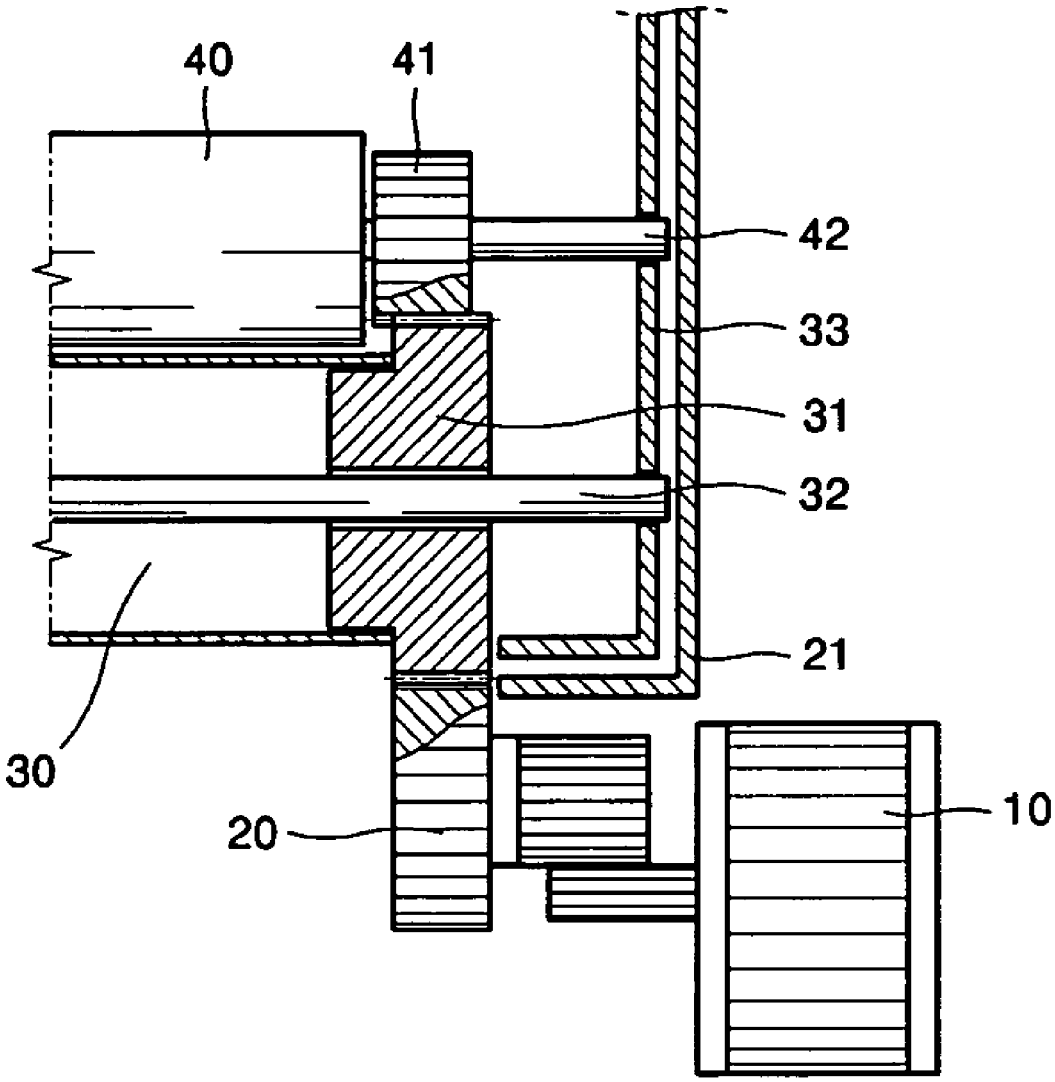
FIG. 2 (PRIOR ART)
FIG. 2 is a cross-sectional view of the developer driving device of FIG. 1.
Figure 3:
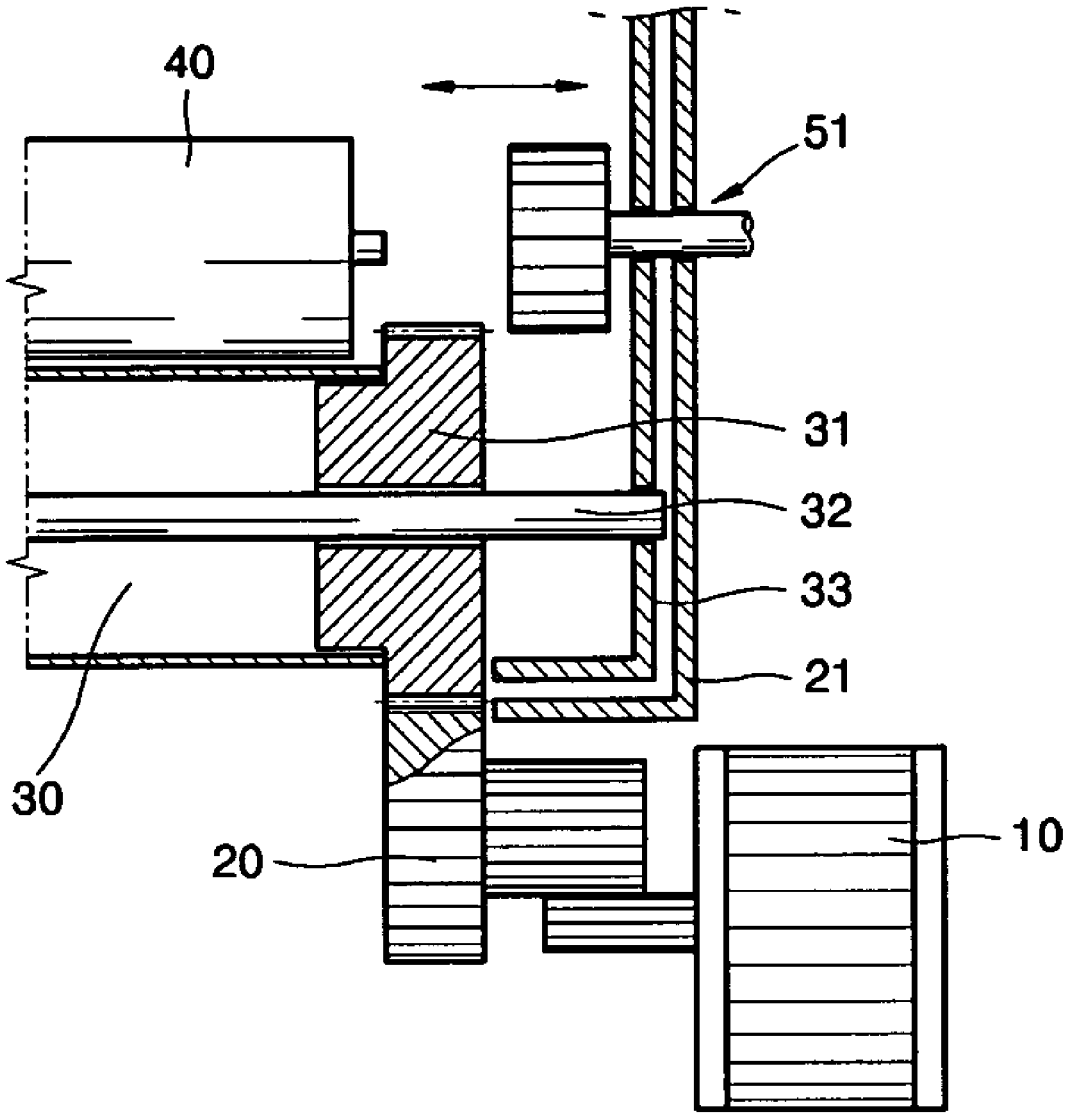
FIG. 3 (PRIOR ART)
FIG. 3 is a cross-sectional view of another example of a conventional developer driving device.
Figure 4:
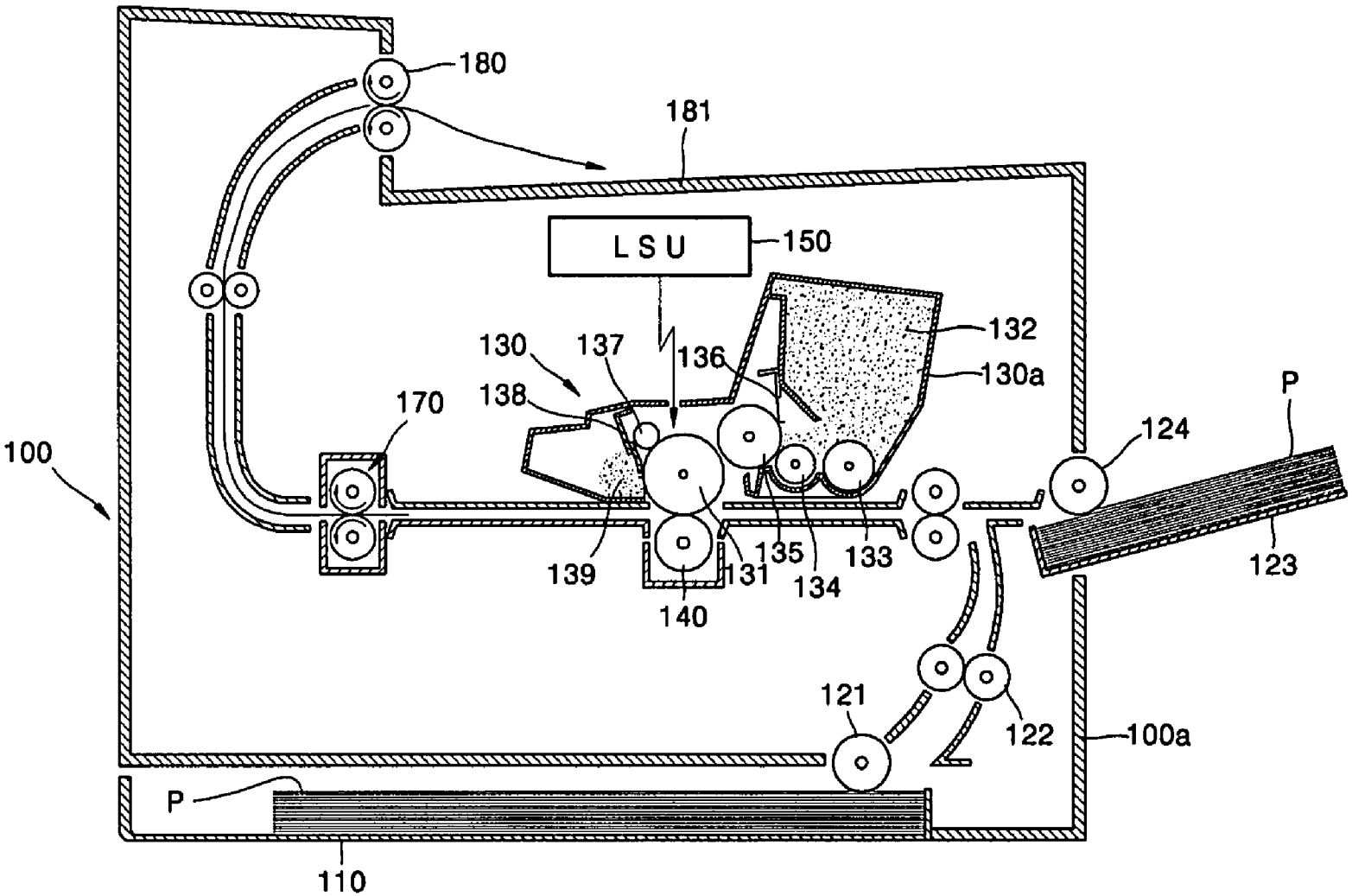
FIG. 4 is a cross-sectional view of a developer driving device applied in an image forming apparatus according to an embodiment of the present invention.

Referring to FIG. 4, an image forming apparatus 100 includes a removable paper cassette 10 to store paper P in the lower portion of a main body frame 100*a*, a multi-purpose feeding tray 123 installed to store paper P at the side of the main body frame 100*a*, and able to be folded into or unfolded from the main body frame 100*a*. Pickup rollers 121 and 124 are respectively installed on top of the paper cassette 110 and the multi-purpose feeding tray 123 to individually feed paper P.

A developer 130 to develop an image and a transfer roller 140 to transfer the developed image onto the paper P are installed on a paper travelling path. Through which paper P, picked up by the pickup roller 121 and transported by a transporting roller 122 and pickup roller 124, travels.

A housing 130*a* covers the developer 130, and a portion of a photosensitive drum 131, which is inside the developer 130, is exposed in the housing 130*a*. On the photosensitive drum 131 an electrostatic latent image is formed by an exposing device 150, such as a laser scanning unit (LSU), and the photosensitive drum 131 is installed to face the transfer roller 140, with the paper P passing between.

In addition, the developer 130 includes a toner storage 132, a toner agitator 133, a developing roller 135, and a supplying roller 134. The toner storage 132 literally stores toner. The toner agitator 133, installed on the lower portion of the toner storage 132, stirs the toner stored in the toner storage so that it does not harden. The developing roller 135, installed a predetermined distance away from the photosensitive drum 131, supplies toner to the electrostatic latent image formed on the surface of the photosensitive drum 131 thereby for forming a toner image. The supplying roller 134, installed to be able to rotate in contact with the developing roller 135, supplies toner from the toner storage 132 to the developing roller 135.

Furthermore, the developer 130 includes a restriction blade 136, a charging roller 137, and a cleaning blade 138. The restriction blade 136, fixed to the housing 130*a*, controls the thickness of the toner that is adhered to the surface of the developing roller 135 by the supplying roller 134. The charging roller 137 charges the surface of the photosensitive drum 131 with a predetermined amount of charge. The cleaning blade 138 removes toner remaining on the surface of the photosensitive drum 131 that is not transferred onto the paper P. Waste toner removed by the cleaning blade 138 is stored in a waste toner storage 139 and is then collected by a collecting device (not shown).

The transfer roller 140 is installed in contact with the photosensitive drum 131 on the opposite side, in order to transfer the toner image formed on the photosensitive drum 131 onto the paper P.

The toner image transferred onto the paper P by the transfer roller 140 is fused and fixed to the paper P as it passes through a fixing device 170, which is installed on the paper travelling path. Then, the paper P is ejected from the main body frame 100*a* by a pair of delivery rollers 180 and piled up on a paper discharge stacker 181.

Figure 5:
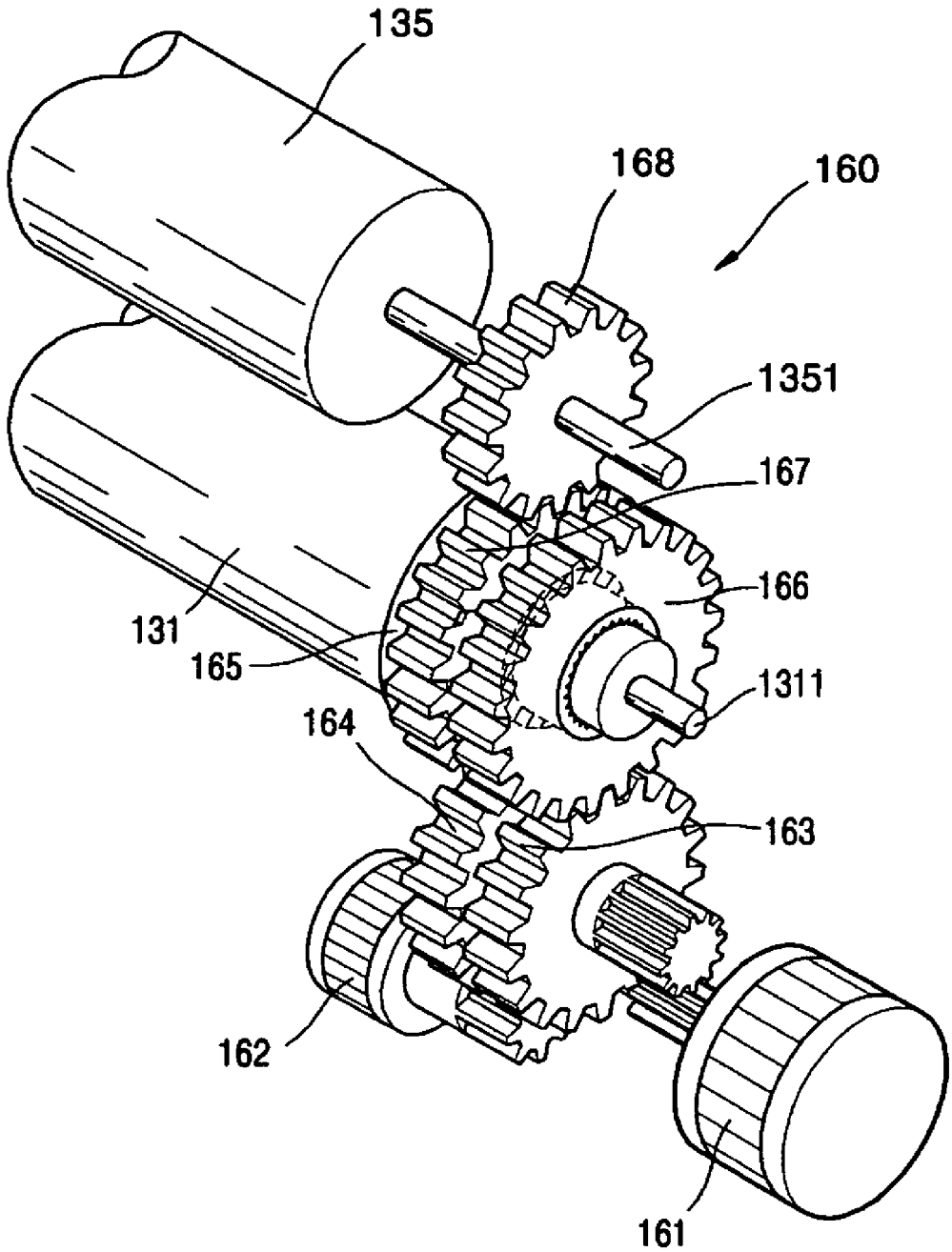
FIG. 5 is a perspective view of a developer driving device according to an embodiment of the present invention.
Figure 6:
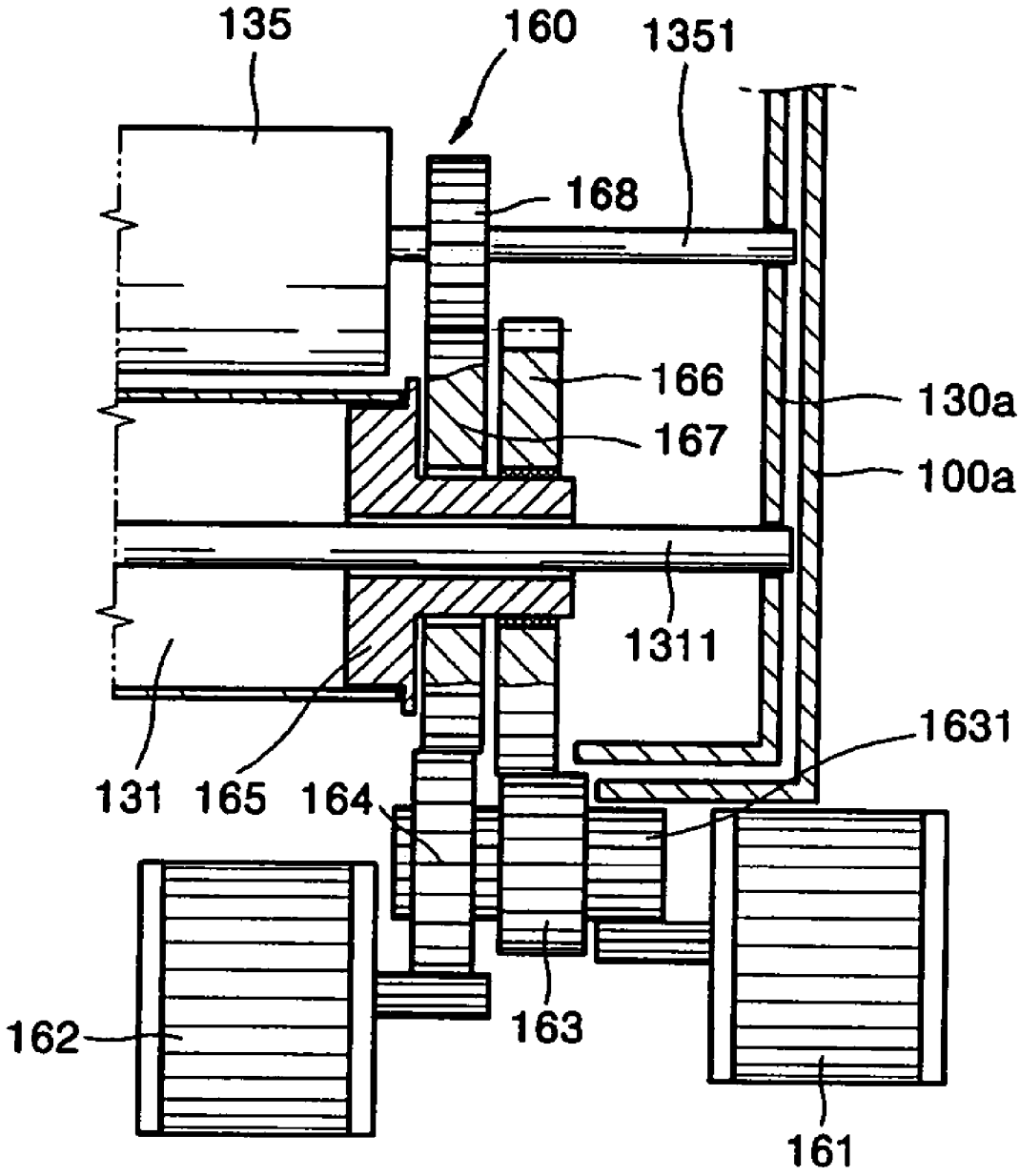
FIG. 6 is a cross-sectional view of the developer driving device of FIG. 5.

Referring to FIGS. 4, 5 and 6, the photosensitive drum 131 and the developing roller 135 rotate in connection with a developer driving device 160. The developer driving device 160 comprises a first driving gear 163 that is connected to a photosensitive drum gear 166, which is installed within the housing 130*a* of the developer 130, and a main motor 161, which is installed on the main body frame 100*a*. The developer driving device 160 also comprises an intermediary gear 167, which is installed within the housing 130*a* of the developer 130, a second driving gear 164 that is connected to a sub motor 162, which is installed on the main body frame 100*a*, and a developing roller driving gear 168, which is installed on the main body frame 100*a*.

One end of the photosensitive drum 131 is formed so as to be able to be inserted in a flange 165. A photosensitive drum axis 1311, which is installed to pass through the flange 165 and is rotatably supported by the housing 130*a* (see FIG. 6) supports the flange 165. The intermediary gear 167 is installed on the flange 165 to accomplish the no-load operation, and the photosensitive drum driving gear 166 is installed adjacent to the intermediary gear 167 to rotate together with the flange 165. The intermediary gear 167 is installed to mesh and rotate with a developing roller driving gear 168 installed on a developing roller axis 1351 of the developing roller 135.

The photosensitive drum driving gear 166 can be inserted into the flange 165 by forcing the photosensitive drum driving gear 166 into the flange 165 or they can be connected by a spool line. These methods are well known to those skilled in the art to which the present invention pertains.

By installing the flange 165 on the photosensitive drum 131, the diameter of the intermediary gear 167, which is installed on the flange 165, can be easily altered. If the diameter of the intermediary gear 167 is changed, the relative speed ratio between the photosensitive drum 131 and the developing roller 135 can be easily altered.

A first driving gear 163 is installed to rotate together with a driving gear axis 1631, which is supported by the main body frame 100*a*. The first driving gear 163 can mesh with the photosensitive drum driving gear 166. A second driving gear 164, adjacent to the first driving gear 163, meshes with the intermediary gear 167 and is able to do no-load operation on the driving gear axis 1631.

Therefore, the driving force of the main motor 161 is successively transferred from the first driving gear 163 to the photosensitive drum driving gear 166, and in turn to the flange 165, and finally to the photosensitive drum 131. The intermediary gear 167 is installed to perform no-load operation to the flange 165 so that the intermediary gear 167 does not rotate even if the flange 165 rotates. The intermediary gear 167 rotates the developing roller driving gear 168 and the developing roller 135 when it receives the driving force from the second driving gear 164, which is driven by the sub motor 162.

Figure 7:
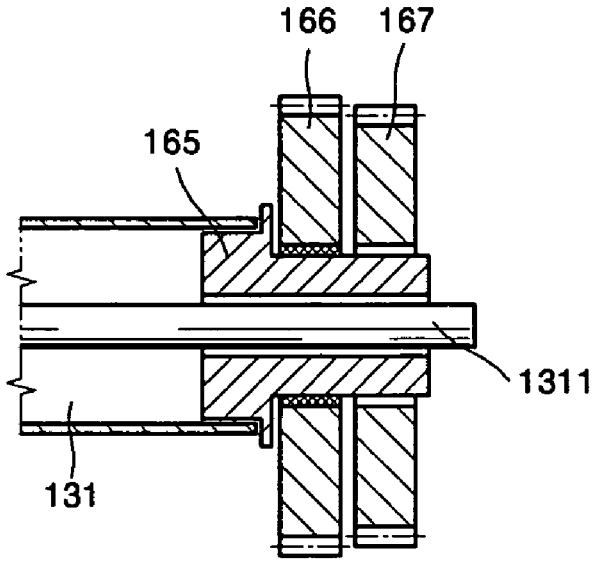
FIG. 7 is a cross-sectional view of another example of the developer driving device according to an embodiment of present invention.

Referring to FIG. 7, the basic structure being the same as FIG. 6, except that the location of the photosensitive drum driving gear 166 and the intermediary gear 167, both installed on the flange 165, are switched. Thus, referring to FIG. 6, the location of the first and second driving gears 163 and 164, and the main and sub motors 161 and 162 are switched according to a driving force transferring relationship.

Figure 8:
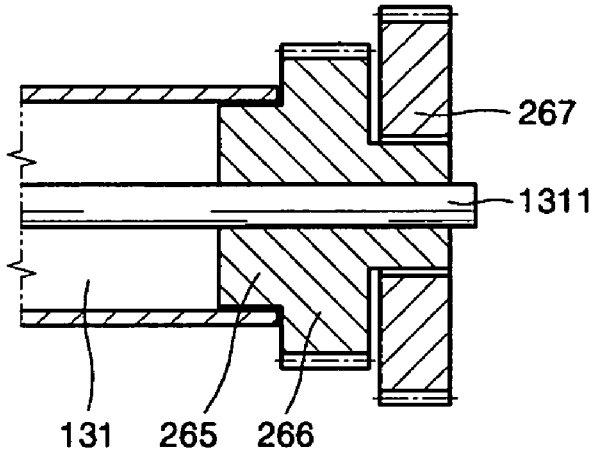
FIG. 8 is a cross-sectional view of a photosensitive drum driving gear and an intermediary gear according to another embodiment of the present invention.

Referring to FIG. 8, a photosensitive drum driving gear 266 is formed as a single body with a flange 265, and an intermediary gear 267 is provided to be able to perform a no-load operation on the flange 265, and therefore it differs from the embodiment illustrated in FIG. 6. As a result, the photosensitive drum driving gear 266 does not need to be manufactured as a separate element.

Figure 9:
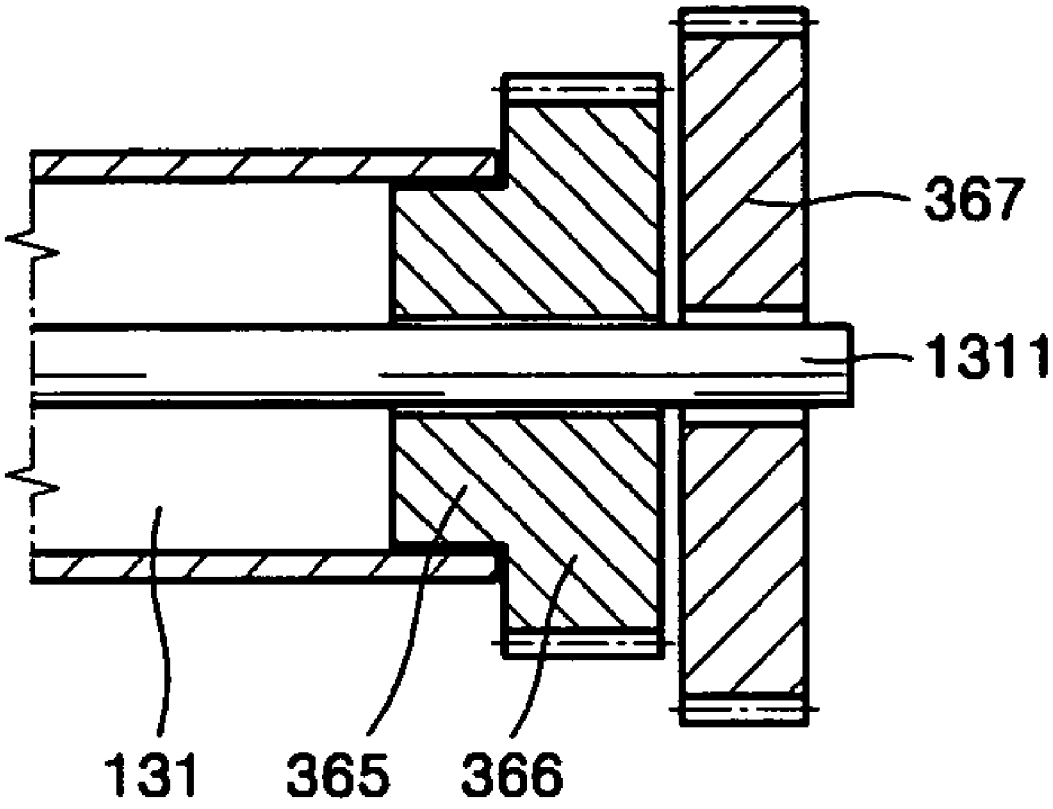
FIG. 9 is a cross-sectional view of a photosensitive drum driving gear and an intermediary gear according to another embodiment of the present invention.

Referring to FIG. 9, a photosensitive drum driving gear 366 is formed as a single body with a flange 365, and an intermediary gear 367 is placed to be able to perform a no-load operation on a photosensitive drum axis 1311, which differs from the embodiment illustrated in FIG. 6. Subsequently, there is no need to produce the photosensitive drum driving gear 366 as a separate element, and the size of the flange can be reduced.

Although not illustrated in FIGS. 6 through 9, a supplying roller driving gear to transfer the force to the supplying roller 134 (see FIG. 4) may be installed on the developing roller axis 1351. Therefore, the supplying roller 134 (see FIG. 4) supplies the toner to the developing roller 135 while rotating together with the developing roller 135.

As described-above, a developer driving device according to exemplary embodiments of the present invention may prevent image irregularity by driving a photosensitive drum and a developing roller with different driving sources, thereby an overload in the developing roller does not affect the photosensitive drum. In addition, the image quality can be improved since stress is not applied to toner.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A developer driving device, comprising:

a photosensitive drum driving gear which is installed on a flange residing at one end of a photosensitive drum on a photosensitive drum axis, and which rotates the photosensitive drum in connection with a main motor of a main body frame; and an intermediary gear installed on the flange to perform a no-load operation, for rotating a developing roller driving gear in connection with a sub motor of the main body frame.

2. The developer driving device of claim 1, wherein the main body frame further comprises:

a first driving gear connected to the main motor; and a second driving gear installed coaxial with the first driving gear, and connected to the sub motor, wherein the first driving gear is connected to the photosensitive drum driving gear, and the second driving gear is connected to the intermediary gear.

3. The developer driving device of claim 1, wherein the photosensitive drum driving gear is formed as a single body with the flange.

4. The developer driving device of claim 1, wherein the photosensitive drum driving gear is formed as a single body with the flange, and the intermediary gear is installed to perform a no-load operation on the photosensitive drum axis.

5. An image forming apparatus having a developer and a developer driving device, the developer including a removable photosensitive drum installed on a main body frame, on which an electrostatic latent image is formed; a developing roller that supplies a developing agent to the electrostatic latent image to develop an image; and a supplying roller that supplies the developing agent to the developing roller, and the developer driving device drives the photosensitive drum, the developing roller, and the supplying roller, the developer driving device comprising:

a photosensitive drum driving gear installed on a flange residing at one end of a photosensitive drum on a photosensitive drum axis, that rotates the photosensitive drum connected to a main motor of a main body frame; and an intermediary gear installed to perform a no-load operation on the flange, for rotating a developing roller driving gear connected to a sub motor of the main body frame.

6. The image forming apparatus of claim 5, wherein the main body frame further comprises:

a first driving gear connected to the main motor; and a second driving gear installed coaxial with the first driving gear, and connected to the sub motor, wherein the first driving gear is connected to the photosensitive drum driving gear, and the second driving gear is connected to the intermediary gear.

7. The image forming apparatus of claim 5, wherein the photosensitive drum driving gear is formed as a single body with the flange.

8. The image forming apparatus of claim 5, wherein the photosensitive drum driving gear is formed as a single body with the flange, and the intermediary gear is installed to perform a no-load operation on the photosensitive drum axis.

* * * * *